United States Patent [19]

Sieja

[11] 4,324,215

[45] Apr. 13, 1982

[54] ENGINE SPEED LIMITING CIRCUIT

[75] Inventor: Norman F. Sieja, Toledo, Ohio

[73] Assignee: Eltra Corporation, Toledo, Ohio

[21] Appl. No.: 145,116

[22] Filed: Apr. 30, 1980

[51] Int. Cl.[3] ..... F02P 1/00; F02A 1/00

[52] U.S. Cl. ..... 123/335; 123/599; 123/602

[58] Field of Search ..... 123/334, 335, 599, 602, 123/625

[56] References Cited

U.S. PATENT DOCUMENTS

| | | | |
|---|---|---|---|
| 3,356,082 | 12/1967 | Jukes | 123/335 |
| 3,581,720 | 6/1971 | Hemphill et al. | 123/335 |
| 3,809,044 | 5/1974 | Jereb et al. | 123/599 |
| 3,863,616 | 2/1975 | Wood | 123/335 |
| 3,875,915 | 4/1975 | Anderson et al. | 123/335 |
| 3,976,604 | 7/1976 | Kondo | 123/335 |
| 3,998,198 | 12/1976 | Jereb | 123/599 |
| 4,010,726 | 3/1977 | Kondo et al. | 123/335 |
| 4,074,665 | 2/1979 | Patis | 123/335 |
| 4,144,859 | 3/1979 | Ohki et al. | 123/335 |
| 4,171,687 | 10/1979 | Coventry | 123/335 |
| 4,186,711 | 2/1980 | Jöerg | 123/602 |

*Primary Examiner*—Raymond A. Nelli

*Attorney, Agent, or Firm*—James P. DeClercq

[57] ABSTRACT

A speed limiting system particularly suited for use with magneto ignition systems for small internal combustion engines is disclosed. A shorting transistor (38) is made conductive for a predetermined time after a first trigger pulse from a trigger coil (12), thus preventing subsequent trigger pulses from being effective above a predetermined engine speed. A capacitor (44) is charged by a trigger pulse, and maintains shorting transistor (38) conductive until it is discharged through the shorting transistor (38), subsequent trigger pulses arriving while shorting transistor (38) is conductive recharging the capacitor (44). A diode (42), which also serves to prevent the capacitor (44) from discharging through the trigger coil (12), provides for normal ignition system operation by delaying operating of the shorting transistor (38) until a trigger pulse has become effective upon the gate (34) of a SCR (30).

9 Claims, 4 Drawing Figures

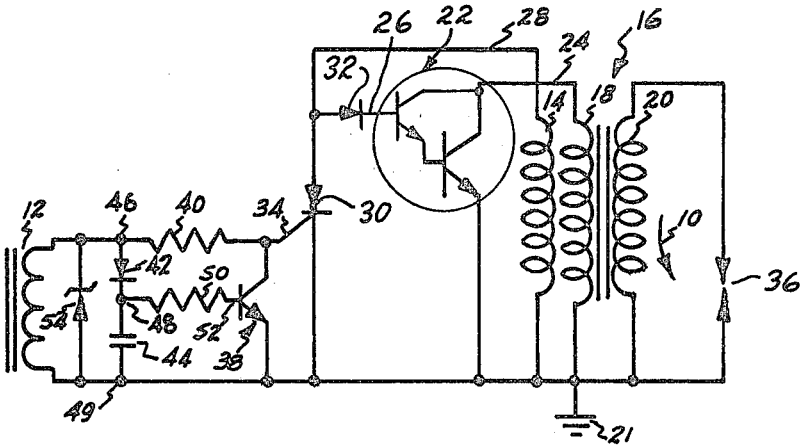
Fig. 1
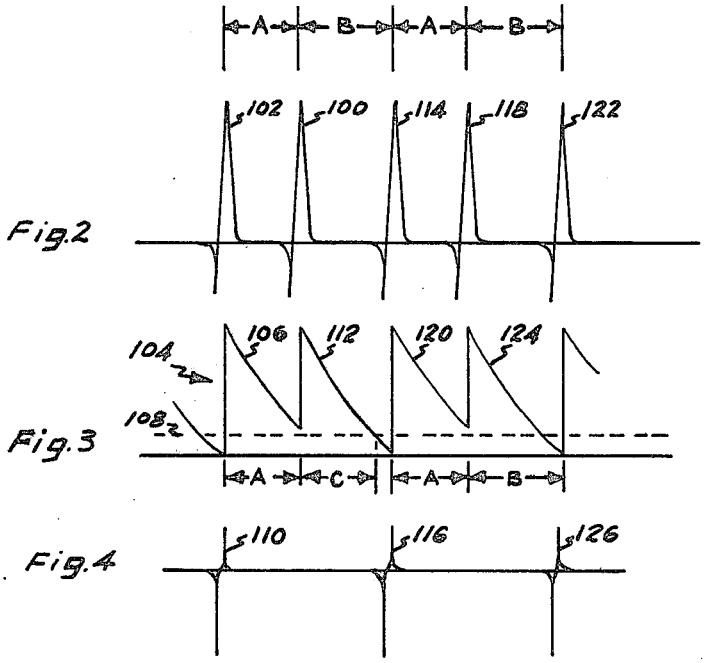
Fig. 2
Fig. 3
Fig. 4

ENGINE SPEED LIMITING CIRCUIT

BACKGROUND OF THE INVENTION

This application relates to speed limiting of internal combustion engines. In particular, the application relates to speed limiting of small internal combustion engines provided with a magneto ignition system.

On some small engine applications, there is a need to limit the maximum speed of the engine to some specific value, either for safety reasons or for limiting the speed of a vehicle on which such an engine is used. This may be necessary to prevent excessive mechanical stresses upon the engine itself, or to accessories attached to the engine, including the magneto flywheel and other such components. One particular application includes hand-held cutting tools powered by such a small engine, where a rotating cutting or drive element may burst when rotated at an excessive speed. In such applications it is common to operate such an engine with its throttle completely open while cutting, for maximum cutting speed and efficiency. However, when the cut is completed, or when the tool is lifted from the work, full-throttle operation may result in dangerous overspeeding.

Speed limiting to preventing such dangerous overspeeding is conventionally accomplished with a mechanical governor operating the throttle of the engine. Such an arrangement is subject to mechanical wear and is easily tampered with, defeating the speed limiting provision. Another known speed limiting method involves interrupting the spark voltage when the engine exceeds a predetermined speed, causing the engine to misfire, and slow down due to its internal friction. The instant invention provides a control circuit for interrupting the ignition of an engine rotating above a predetermined speed which utilizes a minimum number of components, is reliable and repeatable in operation, compact and light in weight, overcoming numerous deficiencies of the prior art.

SUMMARY OF THE INVENTION

The invention involves an ignition system having a semiconductor device, shown as transistor, connected across the primary winding of an ignition coil, which is energized and deenergized, to allow current to flow in the ignition coil, and to produce an ignition impulse. The invention operates by energizing a second semiconductor device to short the trigger pulse to a gate input of a first semi-conductor device, shown as an SCR, when engine rotation exceeds a critical speed. Above that critical speed, a capacitor in a network connected to an input of the shorting device, and charged by an ignition trigger pulse, does not have an opportunity to discharge before the next trigger pulse, maintaining the shorting device in a conductive state at the time of the succeeding trigger pulse. Below the critical speed, the capacitor has adequate time to discharge before the following trigger pulse arrives, and the shorting device is in a non-conductive state. The charging current required by the capacitor insures that, below critical speed, the semiconductor device connected across the ignition coil will be deenergized to provide an ignition impulse before the shorting device is energized.

It is an object of the invention to provide a small engine ignition system adapted to limit the speed of the engine by disabling the ignition system when the engine rotates above a predetermined speed. It is an advantage of the invention that such a speed limiting function may be easily implemented, involving a minimum number of additional parts, and adding minimum weight, bulk, and complexity, to an engine incorporating such an ignition system. It is a feature of the invention that the triggering signal for the ignition system is shorted, disabling the ignition system, when a single capacitor has not had an opportunity to discharge before a succeeding trigger pulse occurs.

BRIEF DESCRIPTION OF THE DRAWINGS

FIG. 1 is a circuit diagram of an ignition system according to the invention.

FIG. 2 is a diagram showing the ignition trigger voltage obtained using the ignition system shown in FIG. 1.

FIG. 3 is an illustration of the voltage across a capacitor of the ignition system shown in FIG. 1.

FIG. 4 is an illustration at the waveform applied to a triggering device of the ignition system shown in FIG. 1 when engine speed exceeds a predetermined limit.

DESCRIPTION OF THE PREFERRED EMBODIMENT

FIG. 1 shows an ignition system according to the invention. A rotating magnetic field 10 is magnetically coupled to a trigger coil winding 12, a drive coil winding 14, and to an ignition coil 16 having a primary coil winding 18 and secondary coil winding 20. One end of coils 12, 14, 18 and 20 is connected to ground 21. A semiconductive switching means shown as transistor 22 is connected between a terminal 24 of coil 18 and ground 21, and has an input 26. A second semiconductor device 30 is connected between a terminal 28 of coil 14 and ground 21. Terminal 28 is also connected to control terminal or input 26 of semiconductor device 22, for example through third semiconductor device 32. Semiconductor device 30, shown as an SCR, has gate input 34, which is responsive to a signal in trigger coil 12, responsive to rotating magnetic field 10. Semiconductor device 22 is preferably a Darlington transistor.

In an ignition system not provided with a speed limiting circuit according to the invention, the rotation of rotating magnetic field 10 induces a drive voltage in coil 14, which provides control current for transistor 22, rendering it conductive and permitting a build up of magnetic flux in ignition coil 16. Then, as flux in ignition coil 16 reaches its maximum, rotating magnetic field 10 induces a trigger signal in trigger winding 12, which is applied to SCR 30 to place it in a conducting state. When SCR 30 conducts, transistor 22 is deenergized and ceases to conduct. When transistor 22 is deenergized, current ceases to flow through coil 18, and the magnetic flux in ignition coil 16 collapses. The collapse of this flux induces a high voltage in secondary coil 20, which is applied to a spark plug 36 to operate the engine. The latching characteristic of SCR 30 allows transistor 22 to remain non-conductive until rotating magnetic field 10 has ceased to induce voltage in drive winding 14 and ignition coil 16. According to the invention, a threshold shorting device shown as transistor 38 is connected between gate input 34 of SCR 30 and ground 21. A resistive means, here shown as resistor 40 is interposed between trigger coil 12 and input 34. A rectifying diode means here shown as diode 42 and capacitive means, here shown as capacitor 44 are placed in series, and connected across trigger coil 12, diode 42 having a first terminal 46 connected to coil 12, and a second terminal connected to junction 48, capacitor 44 having a terminal connected to junction 48, and a second terminal 49 connected to ground 21. A resistive means, here shown as resistor 50, is interposed between junction 48 and the control terminal 52 of threshold shorting or switching device 38. A voltage regulating means shown as zener diode 54 may be connected across trigger coil 12.

In operation, during each revolution of rotating magnetic field 10, a positive voltage pulse is generated in trigger coil 12, which appears at the gate input 34 of SCR 30 and causes it to change from non-conducting state to a conducting state. This action controls transistor 22 to cause a spark to appear at spark plug 36. A triggering pulse is necessary to produce each spark. As will be apparent, the positive trigger pulse generated by trigger winding 12 can not, as applied to gate input 34 of SCR 30, exceed a value greater than approximately 0.7 volts due to the inherent characteristics of SCR 30. Resistor 40, interposed between gate input 34 and trigger coil 12, allows the voltage across trigger winding 12 to rise to a much higher value while the voltage at gate input 34 of SCR 30 remains at essentially 0.7 volts. The addition of a resistor 40 has no adverse effect on the normal operation of the ignition system because the voltage required by gate input 34 of SCR 30 is substantially lower than the voltage available from trigger coil 12. The larger voltage now appearing across trigger winding 12 is used to charge capacitor 44 through diode 42. Diode 42 serves to insure that the capacitor 44 is charged only in a positive direction and to insure that, once charged, it can not discharge through trigger winding 12.

Capacitor 44 charges essentially to the peak value of the positive portion of the trigger pulse generated in trigger coil 12. When the voltage across capacitor 44 exceeds the threshold voltage, about 0.7 volts, of the threshold shorting device shown as transistor 38, capacitor 44 will begin to discharge through resistor 50, and input 52 of the threshold shorting device shown as transistor 38, forcing transistor 38 to a conductive state, and shorting gate input 34 of SCR 30. The time for capacitor 44 to discharge to a voltage below which transistor 38 will be rendered non-conductive is determined by the value of capacitor 44, the value of resistor 50, and the magnitude of the voltage pulse from trigger coil 12, which is, if not otherwise limited, proportional to the speed of rotation of rotating magnetic field 10. In the illustrated embodiment, a voltage regulating means shown as zener diode 54 is connected across trigger coil 12 to regulate the amplitude of voltage pulses from trigger coil 12, and reduce the variation in critical speed which may be obtained in ignition systems according to the invention.

As will be apparent, under normal operation SCR 30 must be energized before transistor 38 is energized. Diode means such as diode 42 have a forward voltage drop, often near 0.7 volts, here the same as the input characteristic of gate input 34 of SCR 30. As illustrated, the voltage at terminal 46 of diode 42 must then be approximately twice the voltage required to energized SCR 30, to energize transistor 38. Therefore, as the voltage across trigger coil 12 rises with the rotation of rotating magnetic field 10, SCR 30 will be energized prior in time.

However, should engine rotation, and hence the rotation of rotating magnetic field 10, exceed a predetermined rate, capacitor 44 will not yet have discharged, and transistor 38 will still be in a conductive state at the time of the next trigger signal generated in trigger coil 12. Under these conditions, an ignition pulse will be prevented by the threshold shorting device shown as transistor 38.

Turning now to FIGS. 2, 3, and 4, a trigger signal pulse 100 is shown, occuring a time interval A after a trigger signal pulse 102, time interval A being indicative of a speed of rotation of rotating magnetic field 10 above the desired critical limit. As shown in FIG. 3, an illustration of the voltage 104 across capacitor 44, capacitor 44 has been charged in response to trigger signal pulse 102, and decays along slope 106. However, as shown in FIGS. 2 and 3, at the time of arrival of succeeding trigger signal pulse 100, voltage 104 has not returned to threshold 108 of input 52 of transistor 38, capacitor 44 requiring a time interval C to discharge to threshold 108, transistor 38 remaining conductive and preventing an ignition pulse. Comparing FIGS. 2, 3 and 4 an ignition pulse 110 was produced in response to trigger signal pulse 102, but, transistor 38 being conductive, no ignition pulse is generated in response to trigger signal pulse 100. However, trigger signal pulse 100 recharges capacitor 44, which begins decaying along slope 112. Comparing FIGS. 2, 3 and 4, it will be noted that an ignition pulse 110 was produced in response to trigger signal pulse 102, but that no such ignition pulse was produced in response trigger signal pulse 100.

The associated engine, having misfired, will start to slow down due to forces in the engine and its load. As shown, the engine speed decreases to a speed below critical speed, a trigger signal pulse 114 being produced at time interval B after trigger signal pulse 100, which is indicative of an engine speed below critical speed. Capacitor 42 having discharged along slope 112 to a value below threshold 108, an ignition pulse 116 will be produced. If, for instance, the over speeding condition was as a result of removing the load from a cutting tool, ignition pulse 116 will result in the engine speed increasing beyond critical speed, a trigger signal pulse 118 being generated at a time interval A after trigger signal pulse 114 which is indicative of engine speed above critical speed. Capacitor means 44, having been charged in response to trigger signal pulse 114, and decaying along slope 120, will not have reached threshold 108 before trigger signal pulse 118 is produced, threshold device 38 remaining conductive, and no ignition pulse being generated. As before, this will cause the engine to slow down, the next trigger signal pulse 122 arriving at time interval B after trigger signal pulse 118, indicative of engine speed below critical speed, and the voltage across capacitor means 44, decaying along slope 124, reaches threshold 108 prior to the arrival of trigger signal pulse 122, and produces ignition pulse 126. This sequence will repeat, with the rate of production of ignition pulses such as 110, 116, and 126, being determined by the load upon the engine and the throttle setting.

Numerous variations and modifications of the disclosed invention, including substitutions of components and combining separate disclosed components into a single component, will be apparent to one skilled in the art, and may be made without departing from the spirit and scope of the invention.

I claim:

1. A speed limiting circuit for a magneto ignition system for an engine, including a rotating magnetic field, comprising:

an ignition coil;

a secondary winding of said ignition coil being operably connected to a spark plug;

a primary winding of said ignition coil being magnetically coupled to said secondary winding and having a current therein induced by said magnetic field;

switching means connected to said primary winding for switching said current to cause an ignition pulse at said spark plug;

latching means operatively connected to said switching means for controlling said switching means;

a trigger coil means responsive to said magnetic field and being operably connected to said latching means for providing a trigger signal for energizing said latching means;

shorting means operably connected to said latching means and to said trigger coil means, and responsive to said trigger signal, for shorting said trigger signal for a predetermined interval following a first said trigger signal, to prevent a second said trigger signal within said predetermined interval from being effective to energize said latching means.

2. A speed-limiting circuit for a magneto ignition system for an engine, including a rotating magnetic field, comprising:

an ignition coil;

a secondary winding of said ignition coil being operably connected to a spark plug;

a primary winding of said ignition coil being magnetically coupled to said secondary winding and having a current therein induced by said magnetic field;

switching means connected across said primary winding for carrying said current and interrupting said current at a predetermined time to cause an ignition pulse at said spark plug;

latching means connected to a control terminal of said switching means for controlling said switching means, said switching means having a control terminal;

a trigger coil responsive to said magnetic field and having a first terminal operably connected to a control terminal of said latching means;

rectifying means and capacitor means connected in series between said first and second terminals of said trigger coil and having a junction therebetween, for storing a voltage in said capacitor means responsive to a voltage induced in said trigger coil by said magnetic field;

threshold switching means having a control terminal resistively connected to said junction and responsive to said voltage in said capacitor;

said threshold switching means having controlled terminals connected to said control terminal of said latching means and to said second terminal of said trigger coil respectively for preventing said trigger coil from being effective upon said control terminal of said latching means when engine speed exceeds a predetermined limit;

said threshold switching means becoming effective to prevent said trigger coil from affecting said latching means in delayed response to said trigger coil and remaining effective therefore for a predetermined time thereafter in response to said voltage in said capacitor;

whereby said threshold switching means becomes effective to prevent actuation of said latching means after said trigger coil has caused said ignition pulse and remains effective to prevent subsequent ignition pulses as long as said engine speed is above said predetermined limit.

3. A speed limiting circuit according to claim 2, including:

voltage limiting means connected between said first and second terminals of said trigger coil.

4. A speed limiting circuit for a magneto ignition system for an engine including a rotating magnetic field, comprising:

an ignition coil;

a secondary winding of said ignition coil being connected to a spark plug of said engine;

a primary winding of said ignition coil magnetically coupled to said magnetic field and having a current intermittently induced therein by said magnetic field;

switching means connected across said primary winding for carrying said current and interrupting said current at a predetermined time to cause an ignition pulse at said spark plug;

latching means connected to a control terminal of said switching means for controlling said switching means;

a drive winding for supplying bias voltage to said switching means and to said latching means, said drive winding being magnetically coupled to said magnetic field and having said bias voltage intermittently induced therein;

a trigger coil responsive to said magnetic field and having a first terminal resistively connected to a control terminal of said latching means;

rectifying means and capacitor means connected in series between said first and a second terminal of said trigger coil and having junction thwerebetween, for storing a voltage in said capacitor means responsive to a voltage induced in said trigger coil by said magnetic field;

threshold switching means having a control terminal resistively connected to said junction and responsive to said voltage in said capacitor and providing a discharge path for said voltage;

said threshold switching means having controlled terminals connected to said control terminal of said latching means and to a second terminal of said trigger coil for preventing said trigger coil from being effective upon said control terminal of said latching means when engine speed exceeds a predetermined limit;

said threshold switching means becoming effective to prevent said trigger coil from affecting said latching means in delayed response to said trigger coil and remaining effective therefore, for a predetermined time thereafter;

whereby said threshold switching means becomes effective to prevent actuation of said latching of said latching means after said trigger coil has caused a first said ignition pulse, and remains effective to prevent subsequent said ignition pulses as long as said engine speed is above said predetermined limit.

5. A speed limiting circuit according to claim 4, wherein:

a voltage regulating means is connected between said first and second terminals of said trigger coil.

6. A speed limiting circuit according to claim 4, wherein:

said switching means is a transistor.

7. A speed limiting circuit according to claim 4, wherein:

said switching means is a Darlington transistor.

8. A speed limiting circuit according to claim 4, wherein:

said latching means is a thyristor.

9. A speed limiting circuit according to claim 4, wherein:

said threshold switching means is a transistor.

* * * * *

UNITED STATES PATENT AND TRADEMARK OFFICE

CERTIFICATE OF CORRECTION

PATENT NO. : 4,324,215

DATED : April 13, 1982

INVENTOR(S) : Norman F. Sieja

It is certified that error appears in the above–identified patent and that said Letters Patent are hereby corrected as shown below:

Column 1, line 26, change "preventing" to --prevent--.
Column 3, line 61, change "energized" to --energize--.
Column 4, line 28, after "response" insert --to--.
Claim 4, lines 28-29, change "thwerebetween" to --therebetween--.

Signed and Sealed this

*Third* Day of *August 1982*

[SEAL]

*Attest:*

*Attesting Officer*

GERALD J. MOSSINGHOFF

*Commissioner of Patents and Trademarks*